US005839706A

United States Patent [19]

Liu

[11] Patent Number: 5,839,706

[45] Date of Patent: Nov. 24, 1998

[54] FOLDING COLLAPSIBLE STAND MOUNTING STRUCTURE FOR A BABY WALKER

[76] Inventor: Kun-Hei Liu, 2F., No. 32, Lane 200, Tung Hwa Street, Taipei, Taiwan

[21] Appl. No.: 895,478

[22] Filed: Jul. 16, 1997

[51] Int. Cl.[6] ..... F16M 11/16; F16M 11/42

[52] U.S. Cl. ..... 248/188; 248/170; 248/188.6; 248/439; 297/6; 297/463.1

[58] Field of Search ..... 248/188.6, 166, 248/188, 188.1, 188.2, 170, 171, 439; 297/5, 6, 344.12, 463.1

[56] References Cited

U.S. PATENT DOCUMENTS

| | | | |
|---|---|---|---|
| 4,699,392 | 10/1987 | Ku | 297/5 |
| 5,354,025 | 10/1994 | McCaffrey | 248/188 |
| 5,529,270 | 6/1996 | Liu | 248/166 |
| 5,666,765 | 9/1997 | Sarner et al. | 248/188 |

*Primary Examiner*—Leslie A. Braun
*Attorney, Agent, or Firm*—Varndell Legal Group

[57] ABSTRACT

A folding collapsible stand mounting structure including a pair of parallel locating plates raised from a bottom side of a wheel-equipped base frame of a baby walker within a bottom chamber, each locating plate having a first locating notch and a second locating notch, a screw tube raised from the base frame between the locating plates, an arched locating block fixedly secured to the screw tube by a screw, a stand pivoted to the locating plates of the base frame and secured in place by the arched locating block and turned between a first position in which the stand is received within the bottom chamber of the base frame, and a second position in which the stand is extended out of the base frame outside the bottom chamber for supporting the baby walker firmly on the ground, the stand having two locating rods which are forced into engagement with the first locating notches of the locating plates when the stand is turned to the second position, or the second locating notches of the locating plates when the stand is turned to the first position.

1 Claim, 7 Drawing Sheets

FOLDING COLLAPSIBLE STAND MOUNTING STRUCTURE FOR A BABY WALKER

BACKGROUND AND SUMMARY OF THE INVENTION

The present invention relates to baby walkers, and more specifically to a folding collapsible stand mounting structure of a baby walker which permits the stands of the baby walker to be conveniently extended out for supporting the baby walker firmly on the ground, or folded up and received within the bottom chamber of the base frame of the baby walker for permitting the baby walker to be moved with its wheels.

Conventional baby walkers are equipped with wheels so that they can be moved when the baby walks. However, when a baby walks with a baby walker, the parents must carefully watch the baby to prevent the baby from falling down or touching dangerous matter. There are known baby walkers equipped with folding collapsible stands. When the stands are extended out, they firmly support the baby walkers on the ground. FIG. 1 shows a baby walker of this type. This structure of baby walker, as shown in Figures from 1 to 3, comprises a plurality of stands pivoted to the base frame of the baby walker, a plurality of actuating rods mounted in respectively holes in the base frame and respctively coupled to the stands, a plurality of caps respectively fastened to the actuating rods outside the base frame, a plurality of locating blocks respectively mounted within the stands and fastened to the actuating rods by a respective screw, and a plurality of spring elements respectively mounted around the actuating rods and retained between the base frame and the caps. This complicated stand mounting structure makes the assembly procedure of the baby walker difficult and increses its manufacturing cost. Further, the parts of this stand mounting structure tend to vibrate when the baby walker moves, causing a big noise to be produced.

The present invention has been accomplished to provide a folding collapsible stand mounting structure for a baby walker which eliminates the aforesaid drawbacks. According to the preferred embodiment of the present invention, the folding collapsible stand mounting structure comprises a pair of parallel locating plates integrally raised from a bottom side of a wheel-equipped base frame of a baby walker within a bottom chamber, each locating plate have a first locating notch and a second locating notch, a screw tube raised from the base frame between the locating plates, an arched locating block fixedly secured to the screw tube by a screw, a stand pivoted to the locating plates of the base frame and secured in place by the arched locating block and turned between a first position in which the stand is received within the bottom chamber of the base frame, and a second position in which the stand is extended out of the base frame outside the bottom chamber for supporting the baby walker firmly on the ground, the stand having two locating rods which are forced into engagement with the first locating notches of the locating plates when the stand is turned to the second position, or the second locating notches of the locating plates when the stand is turned to the first position. Because the base frame, the stand, and the arched locating block are respectively injection molded from plastics, the manufacturing cost of the baby walker can be greatly reduced. Furthermore, the stand has two circular blocks bilaterally raised from the inside and supported on the inwardly curved inside wall of the arched locating block, therefore the stand can be smoothly turned between the first position and the second position.

DETAILED DESCRIPTION OF THE PREFERRED EMBODIMENT

Figure 6:
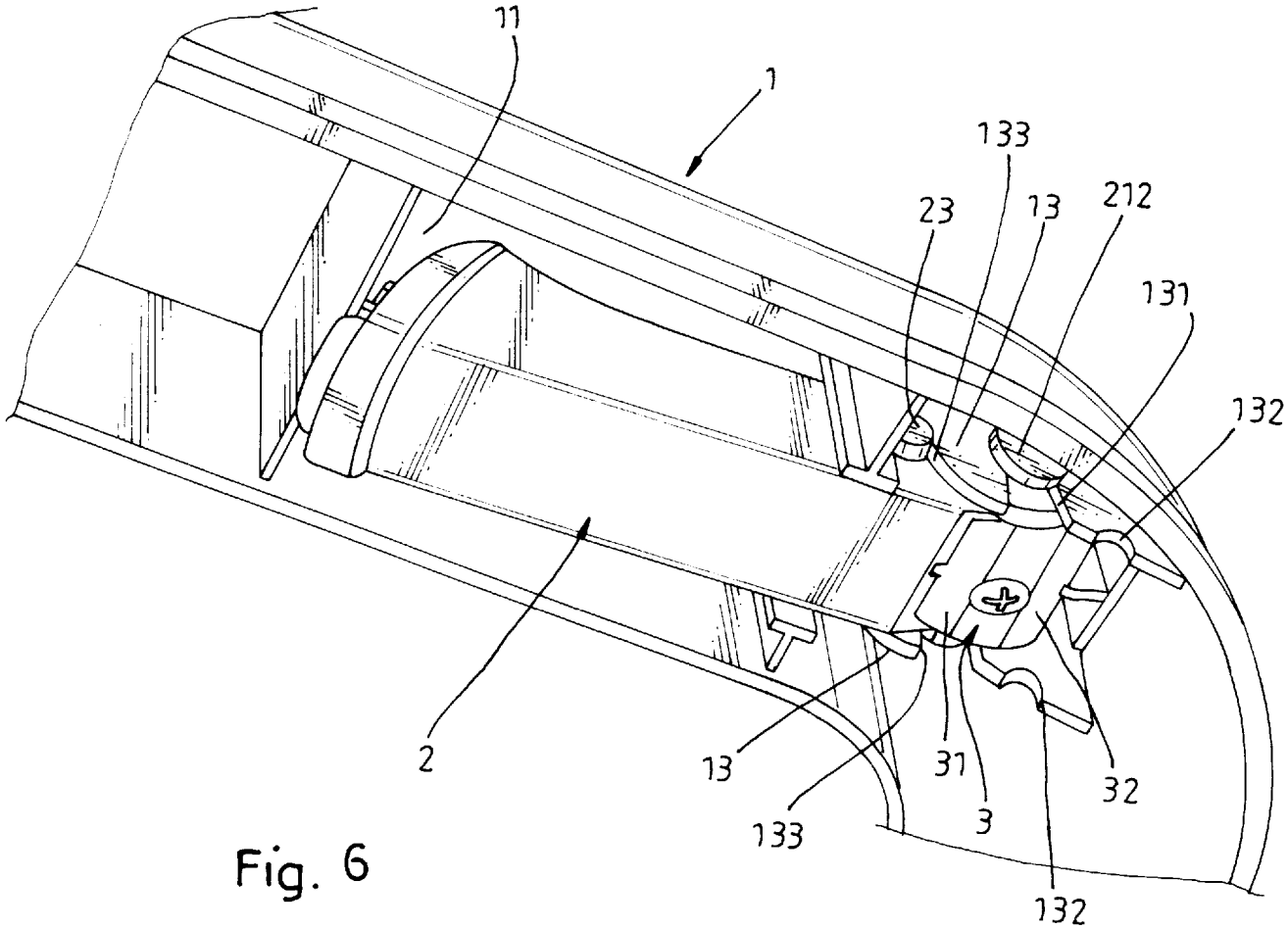
FIG. 6 shows the stand folded up and received within the bottom chamber of the base frame according to the present invention.
Figure 7:
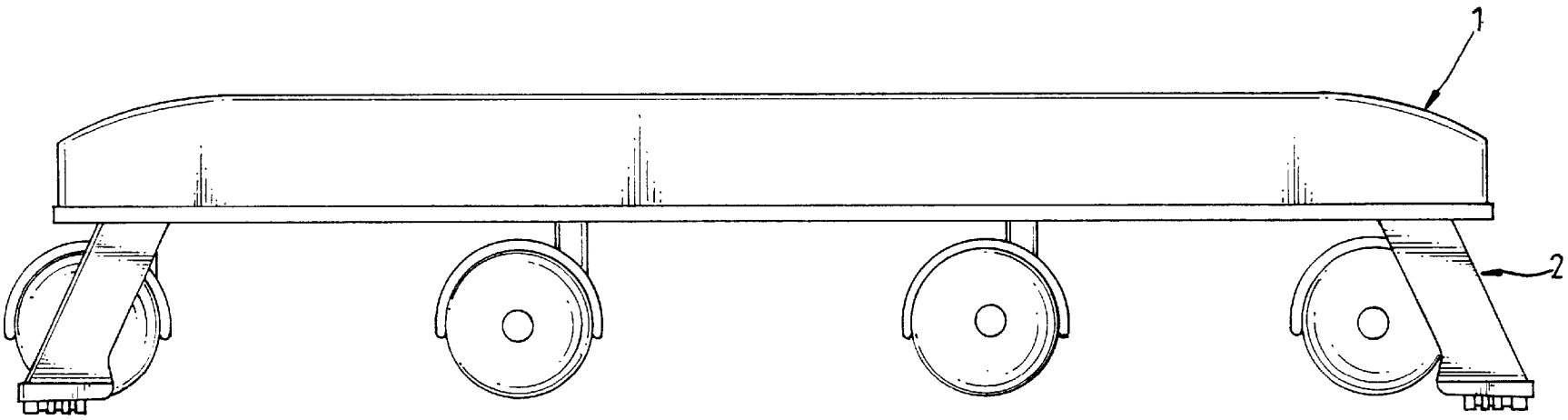
FIG. 7 is a side view showing the stands of the baby walker extended out and set in the operative position according to the present invention.

Referring to Figures from 4 to 7, a plurality of stands 2 are respectively pivoted to a base frame 1 of a baby walker and secured in place by a respective arched locating block 3, and turned between the operative position in which the stands 2 are extended out of the bottom chamber 11 of the base frame 1 for supporting the baby walker firmly on the ground (see FIG. 7), and the non-operative position in which the stands 2 are received within the bottom chamber 11 of the base frame 1 (see FIG. 6) for permitting the baby walker to be moved with its wheels.

The base frame 1 comprises equiangularly spaced pairs of parallel locating plates 13 downwardly disposed within the bottom chamber 11 for holding the stand 2, and a downward screw tube 12 raised from its bottom side within the bottom chamber 11 between each pair of parallel locating plates 13. The parallel locating plates 13 have a respective first locating notch 132 adapted for holding the stands 1 in the operative position, a respective second locating notch 133 adapted for holding the stands 1 in the non-opertive position, and a respective downwardly extended coupling hole 131 spaced between the respective first locating notch 132 and the respective second locating notch 133.

Each stand 2 comprises a coupling head 21 of substantially U-shaped cross section pivoted to one pair of parallel locating plates 13 of the base frame 1, two headed pivots 212 raised from two opposite sides of the coupling head 21 and respectively coupled to the coupling holes 131 of the respective locating plates 13, two locating rods 23 bilaterally raised from the coupling head 21, and two circular blocks 211 bilaterally raised from the inside of the coupling head 21.

Each arched locating block 3 comprises two smoothly curved outside wall portions 31; 32, a screw hole 30 in the middle connected to one screw tube 12 of the base frame 1, and an inside wall portion 33 smoothly curved inwards and disposed in contact with the circular blocks 211 of one stand 2.

Figure 1:
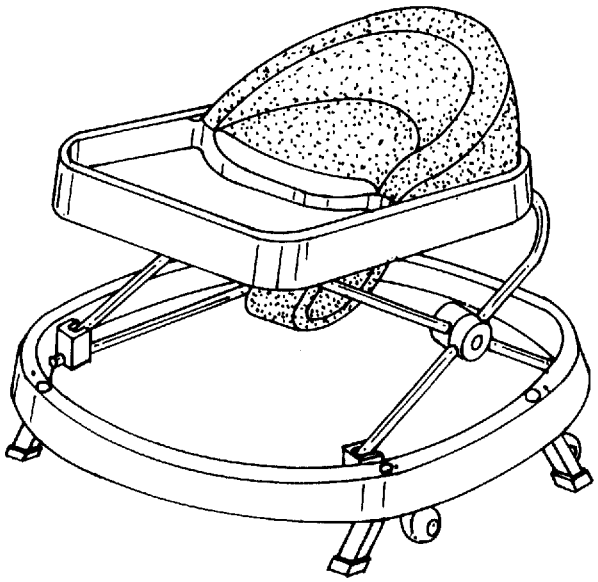
Fig. 1 PRIOR ART
FIG. 1 is an elevational view of a conventional baby walker.
Figure 2:
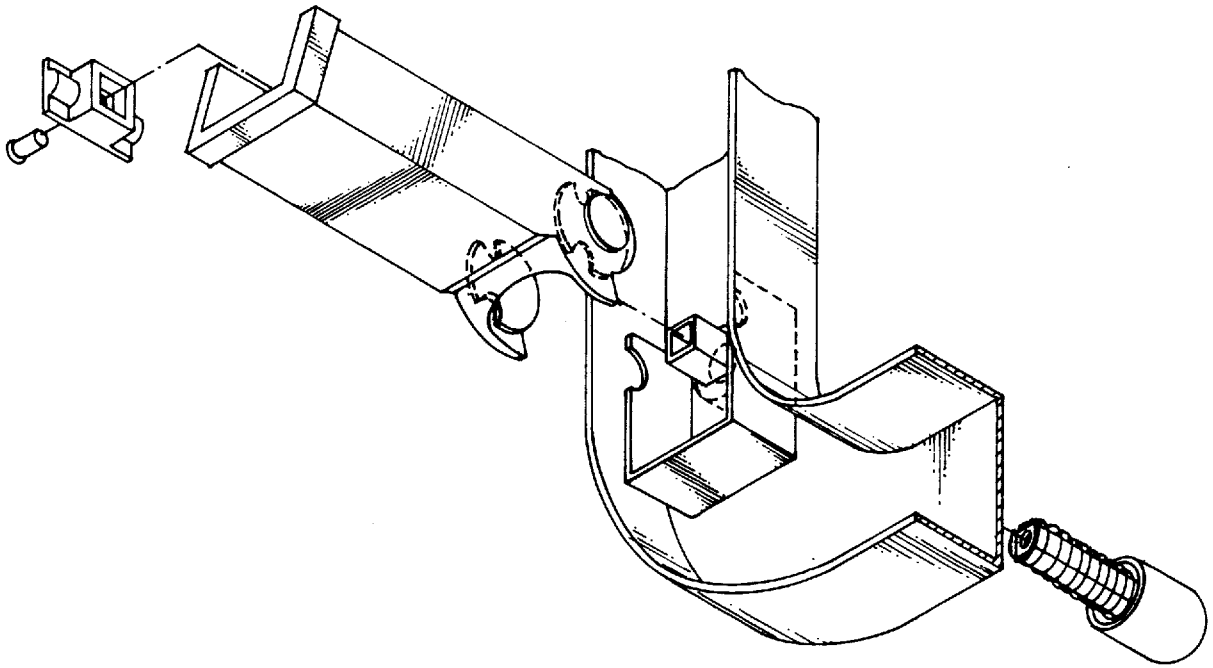
Fig. 2 PRIOR ART
FIG. 2 is an exploded view of the folding collapsible stand mounting structure of the baby walker shown in FIG. 1.
Figure 3:
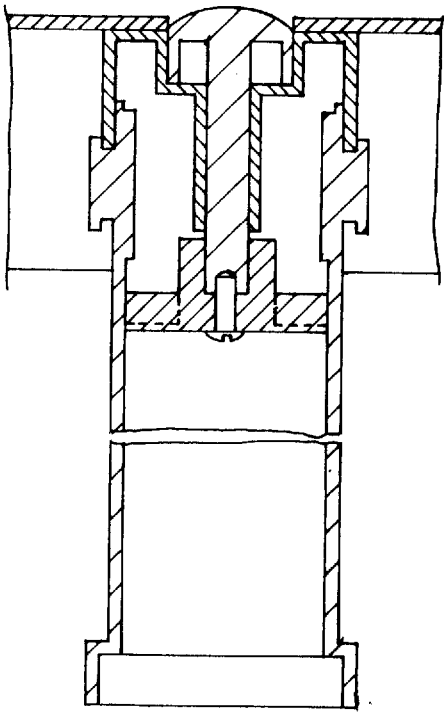
Fig. 3 PRIOR ART
FIG. 3 is a sectional assembly view of FIG. 2.
Figure 4:
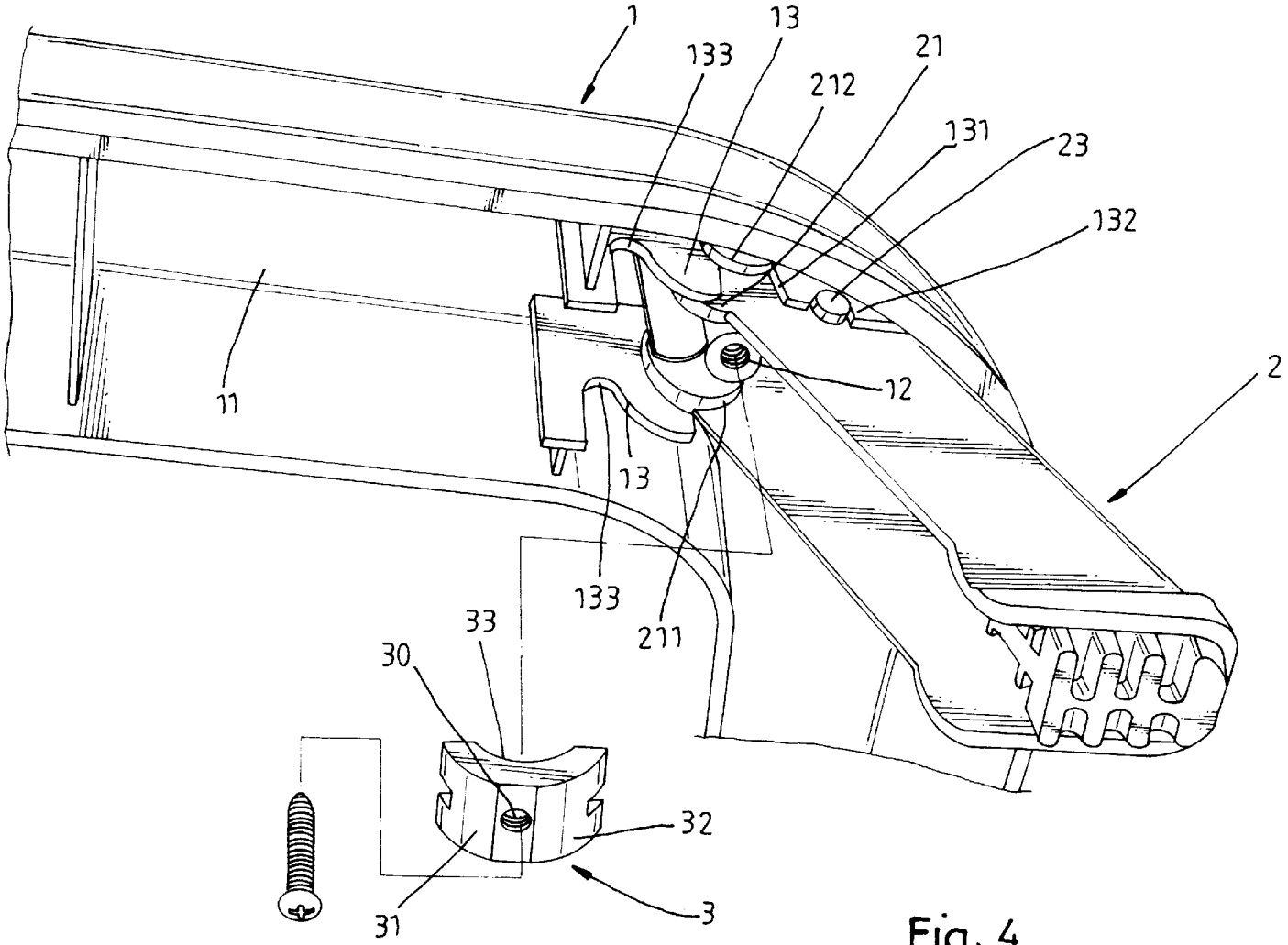
FIG. 4 is an exploded view of the present invention.
Figure 5:
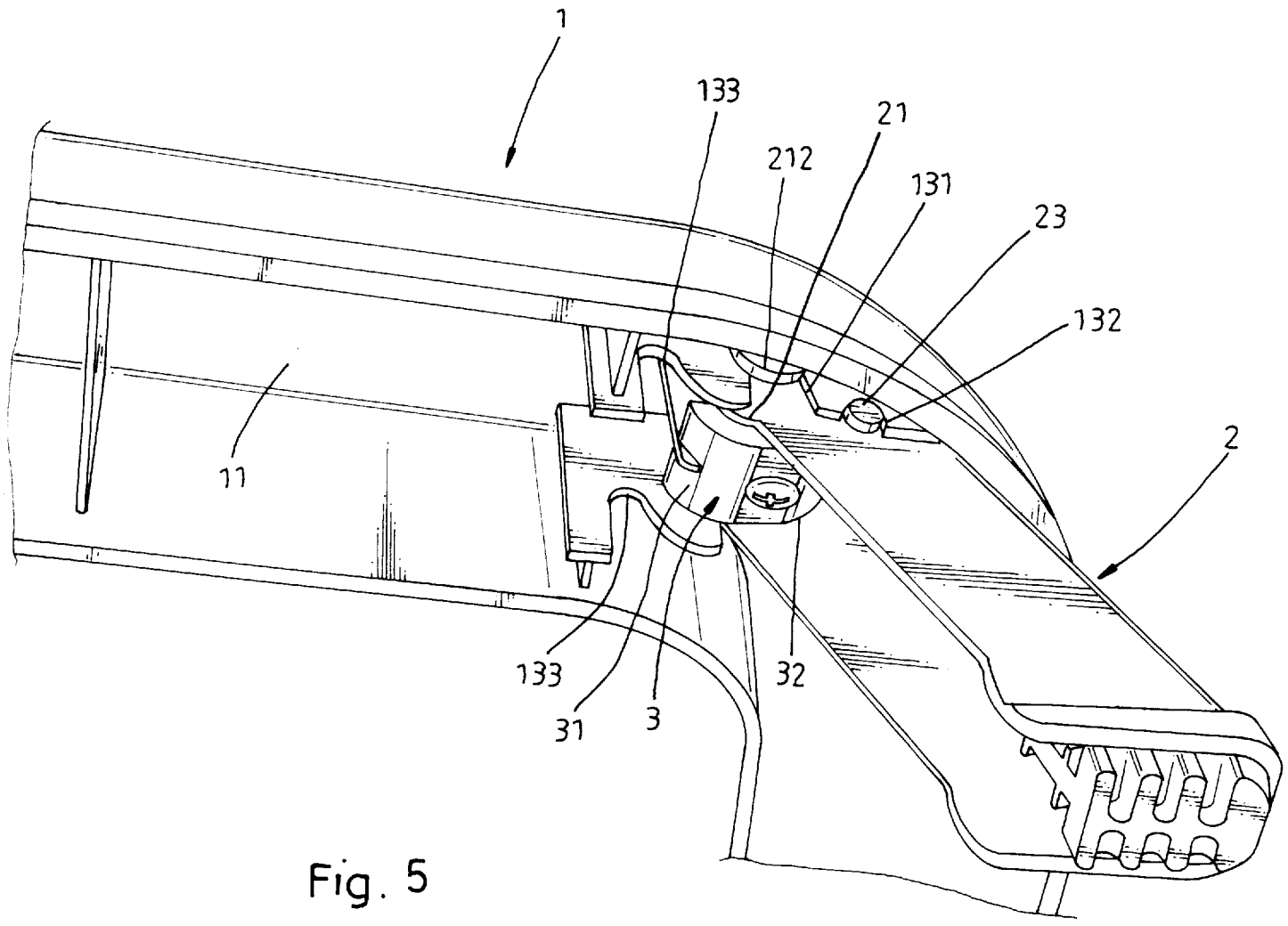
FIG. 5 is an assembly view of FIG. 4.

When the arched locating blocks 3 are respectively fastened to the screw tubes 12 of the base frame 1, the stands 2 are respectively secured in place and can be turned relative to the respective pairs of parallel locating plates 13 between the operative position and the non-operative position. When the stands 2 are respectively turned to the operative position outside the bottom chamber 11 of the base frame 1, the respective locating rods 23 of the stands 2 are respectively forced into engagement with the first locating notches 132 of the respective pairs of parallel locating plates 13, and therefore the stands 2 are retained in the operative position (see FIG. 5). On the contrary, when the stands 2 are respectively turned to the non-operative position and received inside the bottom chamber 11 of the base frame 1, the respective locating rods 23 of the stands 2 are respectively forced into engagement with the second locating notches 133 of the respective Pairs of parallel locating plates 13, and therefore the stands 2 are retained in the non-operative position and received inside the bottom chamber 11 of the base frame (see FIG. 6).

Further, the base frame 1, the stands 2 and the arched locating blocks 3 are respectively injection molded from plastics, therefore the manufacturing cost of the baby walker can be greatly reduced.

It is claimed:

1. A folding collapsible stand mounting structure comprising:

a base frame having a bottom chamber, a pair of parallel locating plates suspending in said bottom chamber, and a downward screw tube suspending in said bottom chamber between said locating plates, said locating plates having a respective first locating notch, a respective second locating notch, and a respective downwardly extended coupling hole spaced between the respective first locating notch and the respective second locating notch;

an arched locating block fixedly fastened to said base frame between said parallel locating plates, said arched locating block comprising, a screw hole in the middle connected to said screw tube of said base frame, and an inside wall portion smoothly curved inwards; and a stand pivoted to said base frame and turned between a first position in which said stand is received within said bottom chamber of said base frame, and a second position in which said stand is extended out of said base frame outside said bottom chamber, said stand comprising a coupling head of substantially U-shaped cross section pivoted to said parallel locating plates of said base frame, two headed pivots raised from two opposite sides of said coupling head and respectively coupled to the coupling holes of said parallel locating plates, two locating rods bilaterally raised from said coupling head, and two circular blocks bilaterally raised from said coupling head on the inside and disposed in contact with the inside wall portion of said arched locating block, said locating rods of said stand being forced into engagement with said first locating notches of said parallel locating plates when said stand is turned to said second position, said locating rods of said stand being forced into engagement with said second locating notches of said parallel locating plates when said stand is turned to said first postion.

* * * * *